United States Patent [19]

Ochiai

[11] Patent Number: 4,475,673

[45] Date of Patent: Oct. 9, 1984

[54] METHOD OF DRYING AND SHAPING CLOTHING AND BODY-SHAPED BAG USED THEREFOR

[76] Inventor: Hiromichi Ochiai, No. 1-28-5, Kakinokizaka, Meguro-ku, Tokyo, 152, Japan

[21] Appl. No.: 384,103

[22] Filed: Jun. 1, 1982

[51] Int. Cl.[3] ..... D06F 71/18; D06F 71/40

[52] U.S. Cl. ..... 223/70; 38/144

[58] Field of Search ..... 223/70; 38/144

[56] References Cited

U.S. PATENT DOCUMENTS

| | | | |
|---|---|---|---|
| 2,513,427 | 7/1950 | Richa et al. | 223/70 X |
| 2,693,042 | 11/1954 | Jacobsen | 38/144 |
| 3,025,622 | 3/1962 | Hilton | 38/144 |
| 3,494,516 | 2/1970 | McMillan | 223/70 X |
| 3,512,703 | 5/1970 | Buckley et al. | 223/70 |
| 3,568,900 | 3/1971 | Paris | 223/70 |
| 4,303,183 | 12/1981 | Schlemon | 223/70 X |

*Primary Examiner*—Louis Rimrodt

*Attorney, Agent, or Firm*—Andrus, Sceales, Starke & Sawall

[57] ABSTRACT

A method of drying and shaping a clothing primarily formed of vegetable fiber or blended with vegetable fiber and synthetic fiber, which has the steps of forming a body-shaped bag formed of grey of hard air permeability, mounting the clothing, and pressing the hem of the clothing, then blowing hot air into the bag, thereby drying and shaping the clothing with the surface heat and the hot air slightly exhausted from the texture of the bag. Thus, the clothing can be advantageously finished via the body-shaped bag formed to provide the surface heat and hot air hardly exhausted through the surface.

7 Claims, 2 Drawing Figures

METHOD OF DRYING AND SHAPING CLOTHING AND BODY-SHAPED BAG USED THEREFOR

BACKGROUND OF THE INVENTION

The present invention relates to a method of drying and shaping a clothing mainly formed of vegetable fiber or blended with vegetable fiber and synthetic fiber such as, for example, an outing shirt, a white garment and coat and so forth and a body-shaped bag used therefor.

Heretofore, a clothing of vegetable fiber is dried and finished by adhering fabric size of wet state to the clothing and drying the clothing with an iron or an iron pressing machine, thereby drying and solidifying the size by means of the heat and pressure of the iron pressing machine. In this case, wet size together with the heat and pressure are required under the conditions.

On the other hand, a clothing mainly formed of animal fiber or blended with animal fiber and synthetic fiber is shaped and finished by a steam iron, a steam pressing machine, a body-shaped steam and hot air finishing machine, a steam cabinet, and a steam tunnel, etc. In this case, the steam and small tension are required under the conditions.

When the steam is sprayed to the animal fiber clothing, since the animal fiber has plasticity with the steam, and the clothing is immediately dried so as not to remain the moisture in the animal fiber, the predetermined shape can be maintained in the clothing. In case of the animal fiber clothing, no size is necessary.

A body-shaped steam and hot air finishing machine used for shaping and finishing an animal fiber clothing, e.g., an upper garment of a sack suit, an overcoat, etc. serves to dry and shape the clothing ordinarily by wearing the clothing to be finished on a body-shaped bag formed of grey of heat resistant, stem resistant and air permeable synthetic fiber, retaining the front of the clothing, then feeding steam into the bag to give sufficient wet heat to the clothing, stopping the steam, thereafter blowing hot air of low temperature (50° to 70° C.) to expand the body-shaped bag, and exhausting the remaining steam from the bag.

It is indispensable to sufficiently eject the steam to finish the animal fiber clothing. If the air flow and pressure are excessibly more than required, the animal fiber will expand, and the flow rate and pressure of the hot air may be in the degree as necessary as the formation of the clothing to be pressed, and the hot air temperature may be preferably lower than 100° C. Because the animal fiber might be damaged at the temperature higher than 100° C.

SUMMARY OF THE INVENTION

Accordingly, a primary object of the present invention is to provide a method of drying and shaping a clothing formed mainly of vegetable fiber or blended with vegetable fiber and synthetic fiber, which can finish the clothing beautifully by the steps of blowing hot air of strong pressure and high heat into a body-shaped bag to expand the entire bag and to impart tension to the clothing and drying and shaping the clothing with hot air slightly ejected through the texture of the grey of hard permeability forming the bag and the surface heat of the bag.

Another object of the present invention is to provide a body-shaped bag for performing the method, which bag can prevent the discharge of large quantity of hot air externally from the interior of the bag with the grey formed in hard air permeability, thereby obtaining necessary tension at the bag, maintaining the surface heat required and eliminating the decrese in the working efficiency due to the discharge of the hot air.

Still another object of the present invention is to provide a body-shaped bag which can dry and shape the superposed portions in double or more laminates of the clothing, e.g., pockets, shoulder portions, etc. similarly to the outer portions of the clothing in the same period of time.

BRIEF DESCRIPTION OF THE DRAWINGS

The specific nature of the invention, as well as other objects, uses and advantages thereof, will clearly appear from the description and from the accompanying drawings, in which.

DESCRIPTION OF THE PREFERRED EMBODIMENTS

The method of drying and finishing a clothing mainly formed of vegetable fiber or blended with vegetable fiber and synthetic fiber, and a body-shaped bag used therefor of the present invention will now be described in more detail with reference to the accompanying drawings, and the finishing machine necessary to shape and finish the clothing of the present invention will be first schematically described.

Figure 1:
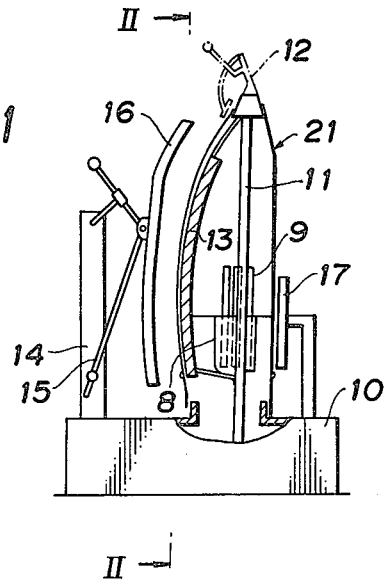
FIG. 1 is a side view of the finishing machine mounted with a body-shaped bag used for the method of drying and finishing a clothing according to the present invention.

A finishing machine has a post 11 stood on the upper surface of a base 10, a neck fixture 12 provided on the top of the post 11, an iron or heater 13 for introducing steam from the neck fixture 12 to the vertical hem of a shirt front, a post 14 stood at the front, and a vertical hem pressing unit 16 provided via a linkage 15 from the post 14. A hot air generator is internally mounted in the base 10. When the hot air generator is operated, the hot air of predetermined quantity is blown from below into the body-shaped bag 21. The body-shaped bag 21 used in this invention is mounted on the finishing machine to cover the post 11 and the heater 13 as shown in FIG. 1.

A Sirrocco fan for blowing hot air used for the finishing machine has a strong power of the blower used for finishing the animal fiber clothing. That is, the fan used for the animal fiber clothing finishing machine has ordinarily 200 W and less than 20 $m^3$/min. of air flow rate of static pressure 0 ($mmH_2O$), but the fan used for the finishing machine of the present invention has 400 to 750 W and 30 to 40 $m^3$/min. of air flow rate of static pressure 0 ($mmH_2O$) or higher.

In the execution of the present invention, the doby-shaped bag which has high heat resistance and strength, is sealed at the neck portion, arm portions and waist portion and is formed at the grey of hard air permeability, is mounted on the finishing machine, the vegetable fiber clothing to be dried and shaped is mounted on the outer periphery of the body-shaped bag, both vertical hems of the clothing are fastened under strong pressure between the vertical hem pressing unit with heat resistance sponge for pressing the vertical hem from the exterior of the clothing and the upper and lower heaters of slender shape provided in the bag, and then high pressure and high temperature hot air sufficient to expand the clothing is blown from the hot air blowing unit at 100° to 200° C. of the surface temperature of the bag.

The vegetable fiber has much stronger wet strength than the animal fiber but has much less wet elongation and less elongation at the wet heating time as well as much higher heat resistant temperature than the animal fiber. Therefore, the vegetable fiber clothing can be efficiently dried, shaped and finished due to the properties of the vegetable fiber described above according to the method of the present invention. Under this conditions, it is necessary that the grey of the body-shaped bag is formed in hard air permeability according to the method of the present invention.

The concrete embodiment of the method of drying and shaping a clothing according to the present invention will now be described in more detail.

The vegetable fiber clothing is washed, is then sized, is then finished at the neck and arm holes by a neck cuffs pressing machine, is further lightly pressed at the tack portion of the arms, and is mounted on the body-shaped bag in the state that the vertical hem of the front of the clothing, the back and both arms are moistened. The neck portion is fastened by the neck fixture, and the arms of the body-shaped bag are inserted into the arms of the clothing. Further, both lower ends of the vertical hem of the clothing are pulled downwardly to elongate the wrinkles, and the surface of the clothing is pressure at the hem by the pressing unit. The body-shaped bag is, of course, mounted on the finishing machine so that the neck and the waist of the clothing are sealed. The ends of the arms of the body-shaped bag are sealed by means, e.g., sewing or the like. Thereafter, the hot air is fed at the flow rate of 25 to 35 $m^3$/min. (in case of static pressure 0) into the body-shaped bag to expand the bag and the air pressure in the bag is maintained at 15 to 25 $mmH_2O$, and the surface temperature of the bag is maintained at 100° to 200 ° C. Further, the heat is applied for 20 to 40 sec. to the body-shaped bag, thereby drying and shaping to finish the clothing.

As described above, the clothing sized and moistened is expanded by the body-shaped bag by means of the hot air of high pressure, and is thus extended and shaped, and is further dried and solidified at the size by the slight hot air ejected through the texture of the grey of the hard air permeability and by the surface heat of the bag. In this manner, the clothing can be dried, shaped and finished.

Since the pressure is internally applied to the clothing according to the method of the present invention, the surface of the clothing thus finished has beautiful appearance peculier for the fiber, and the back surface of the clothing has advantageously relatively smooth state to be readily worn on the human being.

The embodiment of the body-shaped bag used for the method of drying and shaping the clothing of the present invention will now be described in more detail.

The body-shaped bag of the present invention has not only the high heat resistance but also hard air permeability as the most advantageous feature, which can provide necessary tention and can maintain the permeability for retaining the necessary temperature on the surface.

Figure 2:
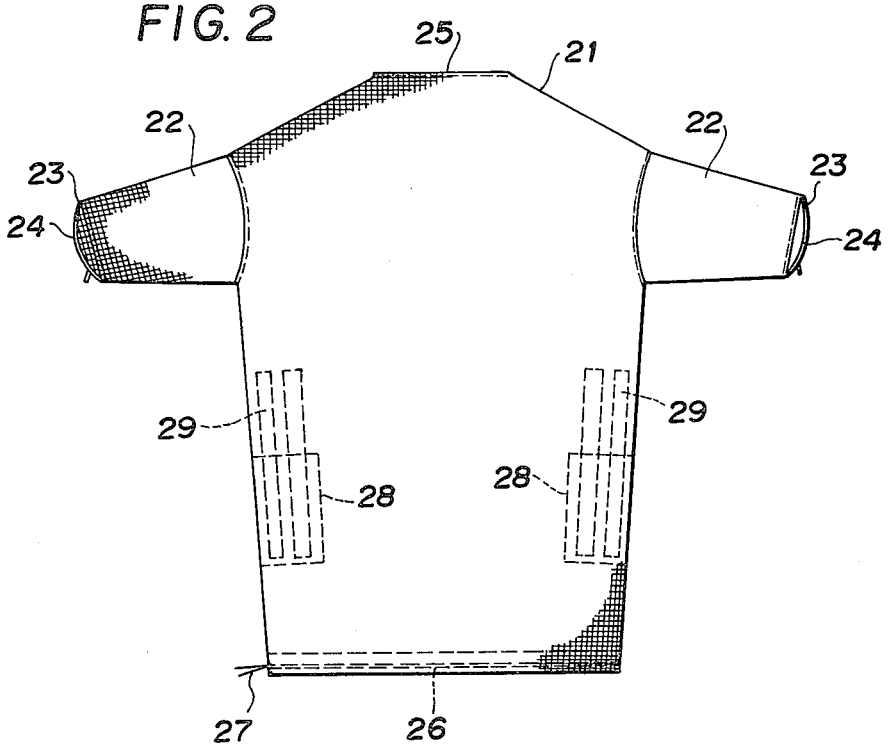
FIG. 2 is a front view of the body-shaped bag constructed according to the present invention.

The body-shaped bag of the present invention has, as shown in FIG. 2, a bag body 21 formed of body, brest, shoulders and neck, right and left arms 22 formed integrally. The ends of the arms 22 are sealed by sewing or the like. The arms 22 are formed in half sleeve length as shown to finish clothings to be readily mounted with the closing. The body-shaped bag also has a neck portion 25 and a waist portion 26 opened at the upper and lower parts. Strings 27 are inserted into the lower portions of the bag body 21 to seqeeze the waist portion when the closing is mounted on the finishing machine. It is noted that when the bag 21 is mounted on the finishing machine, the neck portion 25 and the waist portion 26 are sealed.

Further, a plurality of pockets 28 are aligned at the insides of both sides of the bag 21 and elastic slender rectangular thin plates 29 are respectively inserted into the pockets 28, and are made of steel plates, heat resistant plastic plates, etc. The plates 29 prevents the wrinkles and slacks of the waist of the clothing by natural expansion when the hot air is blown into the interior of the bag to expand the bag 21.

The grey of the body-shaped bag is formed by twill weaving raw polyester yarns of 100 denier for warps and 100 denier for wefts in the density of 214.96 pieces/inch, and has 0.22 mm thick, 28% of longitudinal elongation, 27% of lateral elongation, 3.7 kg of longitudinal tearing strength, 1.7 kg of lateral tearing strength, 187 kg/5 cm of longitudinal tensile strength, 100 kg/5 cm of lateral tensile strength, and is rolled by calender rolls to the degree of 2.5 $cc/cm^2$/sec. of air permeability. The superposed portions, double or more laminates of the pockets, shoulders or the like of the clothing use polyester grey of 5 $cc/cm^2$/sec. of air permeability. Since the melting point of the polyester grey is 240° to 250° C., the body-shaped bag can endure against 200° C. sufficiently. The hem of the body-shaped bag, i.e., the portion to be interposed between the internal iron and the pressing plate may be preferably formed of further high heat resistant grey. Silicone resin may be coated on the texture of the body-shaped bag.

Since the body-shaped bag of the present invention is formed particularly of the grey of the composition described above and the air permeability of the grey is formed to approx. 2.5 $cc/cm^2$/sec. as described above, and to approx. 5 $cc/cm^2$/sec. at the superposed portions, e.g., pockets, shoulders, etc. to be hard air permeable, the bag can be provided with necessary tension and can maintain the necessary temperature to dry the clothing.

What is claimed is:

1. A method of drying and shaping a clothing particularly including a vegetable fibre under a high tensile state comprising the steps of:

forming a body-shaped bag formed of grey having a hard air permeability of substantially 2.5 $cc/cm^2$/sec. with high heat resistance and strength, said bag including a neck, arms and waist and including upper and lower slender iron portions, completely sealing the neck, arms and waist of the bag, mounting the clothing moistened by applying a size thereto, mainly formed of vegetable fiber or blended with vegetable fiber and synthetic fiber on the outer periphery of the bag, pressing the hem of the clothing on said upper and lower slender iron portions by a pressing unit, then blowing hot air of high pressure and heat from below so that the surface temperature of the bag is in the range of 100 to 200° C to expand the bag, and drying and shaping the clothing with the surface heat of the bag, said hot air being slightly exhausted through the texture of the grey of the bag and said pressure being applied to the bag from the interior under the state that said bag and the clothing are tensioned.

2. The method according to claim 1, wherein the hot air is blown at a flow rate in the range of 20 to 35 $m^3$/min. at 0 static pressure and with the air pressure in the bag in the range of 15 to 25 $mmH_2O$.

3. The method according to claim 1, wherein the superposed portions, such as, pockets, shoulders, more than double laminates of said bag are formed with air permeability of approx. 5 $cc/cm^2$/sec.

4. A body-shaped bag comprising:

a bag body formed of grey of hard air permeability of at least 2.5 $cc/cm^2$/sec. with high heat resistance and strength and having a body, breast, shoulders and neck, said neck and waist being integrally formed of right and left arms, the ends of said arms being sealed, the neck and the waist adapted to be sealed on a finishing machine to define an essentially fluid tight bag with limited fluid passage through the bag for heating the bag and placing the bag under tension.

5. The body-shaped bag according to claim 4, having superposed portions of said bag formed of grey of at least 5 $cc/cm^2$/sec. of air permeability.

6. The body-shaped bag according to claim 4, wherein the grey of said bag has raw polyester yarns of 100 denier for warps and 100 denier for wefts twill woven in 214.96 pieces/inch in density, and 0.22 mm thick, 28% of longitudinal elongation, 27% of lateral elongation, 3.7 kg of longitudinal tearing strength, 1.7 kg of lateral tearing strength, 187 g/5 cm of longitudinal tensile strength, 100 kg/5 cm of lateral tensile strength, and is rolled with calendar rollers to the degree of 2.5 $cc/cm^2$/sec. of air permeability.

7. The body-shaped bag according to claim 4, wherein a plurality of pockets are formed in the interior of said bag, and slender rectangular thin elastic plates are inserted into the respective pockets.

* * * * *

UNITED STATES PATENT AND TRADEMARK OFFICE

CERTIFICATE OF CORRECTION

PATENT NO. : 4,475,673

DATED : October 9, 1984

INVENTOR(S) : HIROMICHI OCHIAI

It is certified that error appears in the above-identified patent and that said Letters Patent is hereby corrected as shown below:

Col. 3, Line 11, cancel "this" and substitute therefor ---these---; Col. 3, Line 37, cancel "$mmH_2O$" and substitute therefor ---($mmH_2O$)---; Col. 3, Line 52, cancel "peculier" and substitute therefor ---peculiar---; Col. 3, Line 62, cancel "tention" and substitute therefor ---tension---; Col. 3, Line 66, cancel "brest" and substitute therefor ---breast---; Col. 4, Line 5, cancel "seqeeze" and substitute therefor ---squeeze---; Col. 4, Line 48, cancel "fibre" and substitute therefor ---fiber---; Col. 4, Line 57, after "mounting" cancel "the"; Col. 6, Line 12, cancel "187g/5cm" and substitute therefor ---187kg/5cm---

Signed and Sealed this

*Fourth* Day of *June 1985*

[SEAL]

*Attest:*

DONALD J. QUIGG

*Attesting Officer* *Acting Commissioner of Patents and Trademarks*